US005799677A

United States Patent [19]

Sabatka et al.

[11] Patent Number: 5,799,677

[45] Date of Patent: Sep. 1, 1998

[54] HERMETIC ENCLOSURE FOR TREATING A WORKPIECE WITH A SOLVENT

[75] Inventors: Winston E. Sabatka, Lakeville; Gerald Melin, Stanchfield, both of Minn.

[73] Assignee: Finishing Equipment, Inc., St. Paul, Minn.

[21] Appl. No.: 606,411

[22] Filed: Feb. 23, 1996

[51] Int. Cl.[6] ..... B08B 15/02

[52] U.S. Cl. ..... 134/76; 134/77; 134/131; 134/200

[58] Field of Search ..... 134/76, 77, 200, 134/198, 131; 118/DIG. 7; 454/64

[56] References Cited

U.S. PATENT DOCUMENTS

| | | | |
|---|---|---|---|
| 2,701,575 | 2/1955 | Friedman | 134/77 |
| 2,772,523 | 12/1956 | Ruthner | 134/76 |
| 3,604,436 | 9/1971 | Lipshaw | 134/76 |
| 3,734,108 | 5/1973 | Almegard et al. | 134/76 |
| 3,986,518 | 10/1976 | Sato | 134/76 |
| 4,204,913 | 5/1980 | Sabatka | 202/168 |
| 4,289,586 | 9/1981 | Sabatka | 203/1 |
| 4,665,655 | 5/1987 | Woodard | 134/76 |
| 4,714,010 | 12/1987 | Smart | 134/76 |
| 4,753,255 | 6/1988 | Melin | 134/52 |
| 4,772,357 | 9/1988 | Carlson et al. | 1234/76 |
| 4,931,109 | 6/1990 | Sabatka | 148/249 |
| 4,983,223 | 1/1991 | Dssner | 134/76 |
| 5,118,357 | 6/1992 | Sabatka | 134/15 |
| 5,313,966 | 5/1994 | Sadamori | 134/76 |

*Primary Examiner*—Frankie L. Stinson
*Attorney, Agent, or Firm*—Kinney & Lange, P.A.

[57] ABSTRACT

An apparatus for treating a workpiece, the apparatus including a carriage for holding the workpiece, a first station for transferring the workpiece into and out of the carriage, a first chamber for holding treating fluid, a second station for transferring the workpiece between the carriage and the first chamber, and a mechanism for staging the carriage, the mechanism capable of positioning the carriage at the first station and at the second station and the first chamber capable of being isolated from atmosphere when the carrier is located at the second station.

23 Claims, 10 Drawing Sheets

Fig. 3a
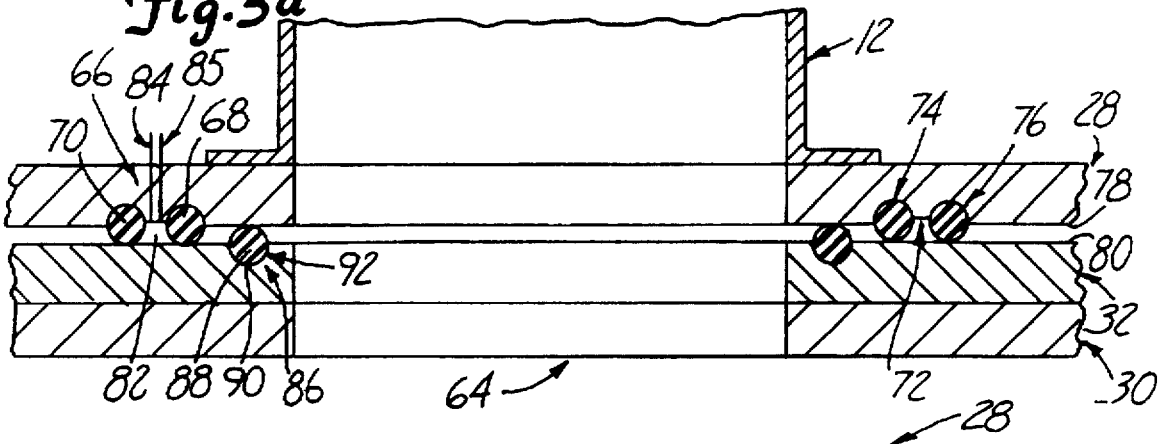
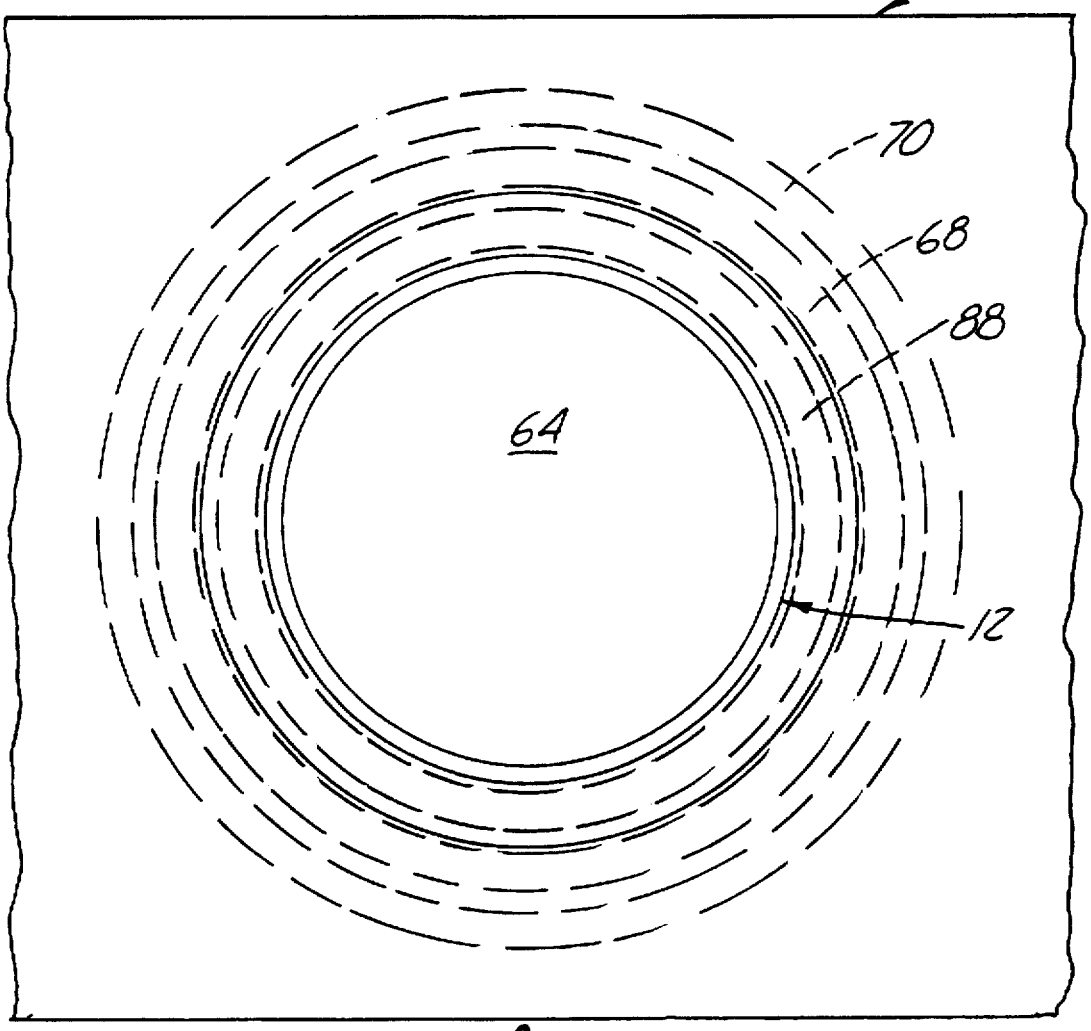
Fig. 3b

STEP 1

STEP 2

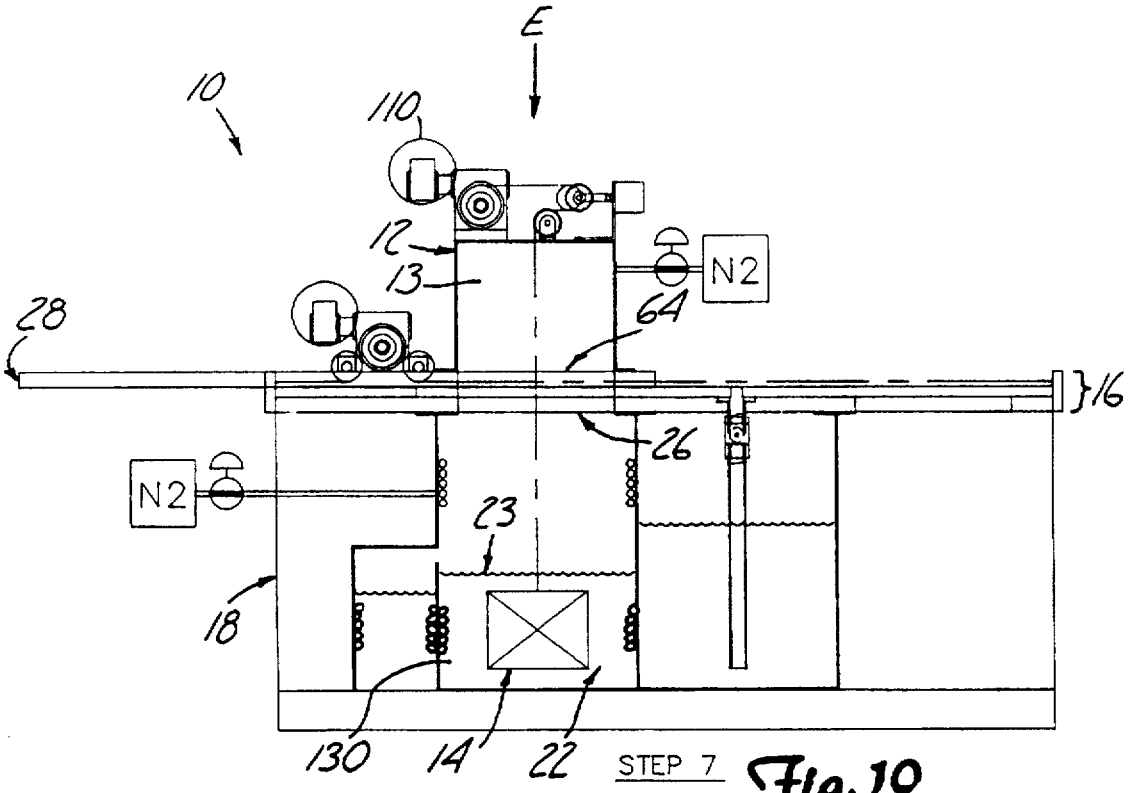
STEP 7 Fig. 10
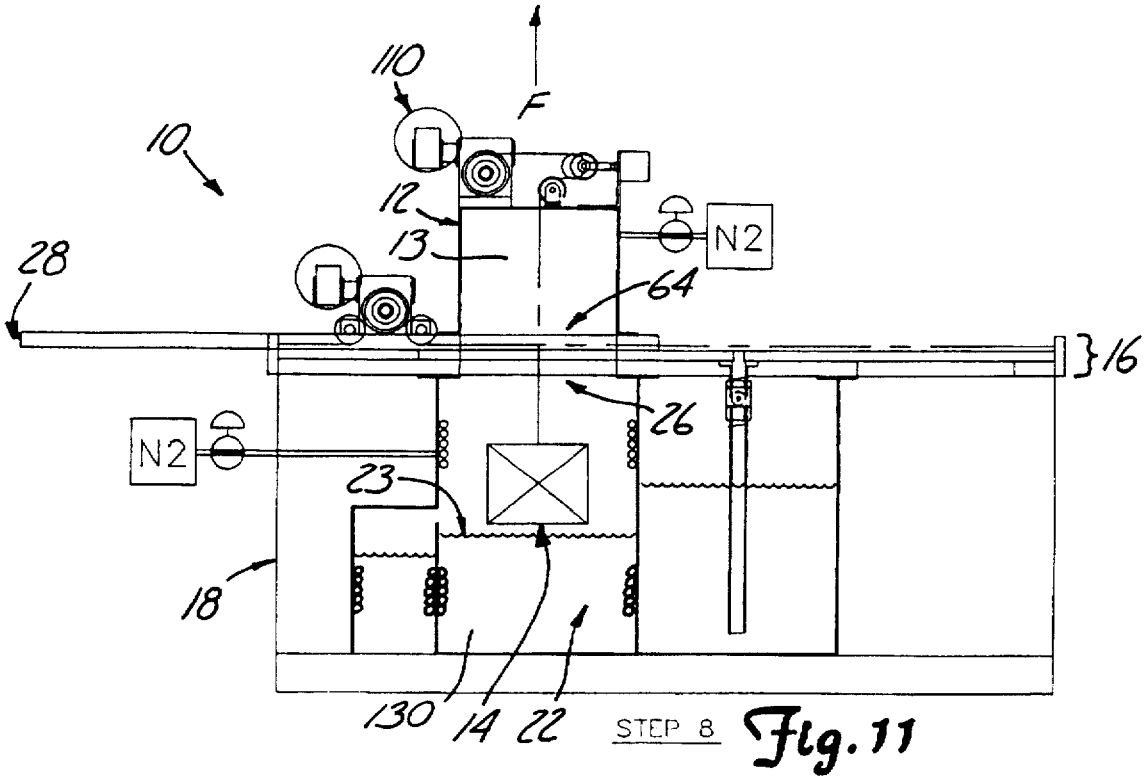
STEP 8 Fig. 11

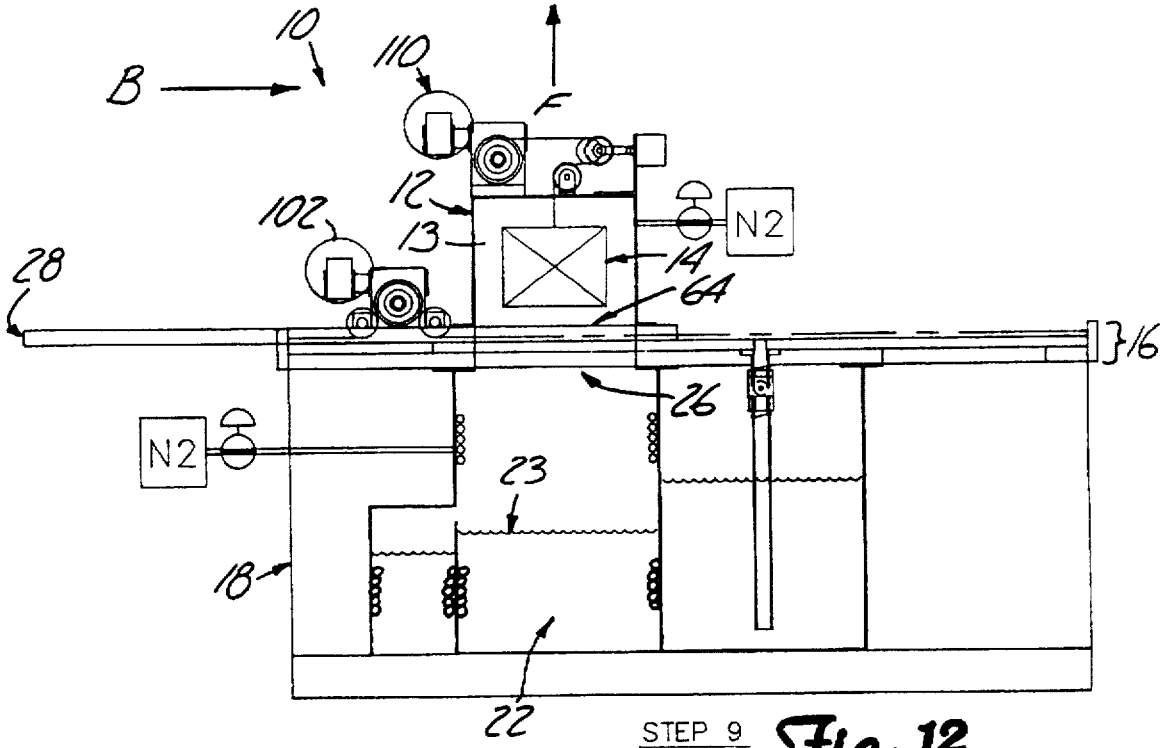
STEP 9 Fig. 12
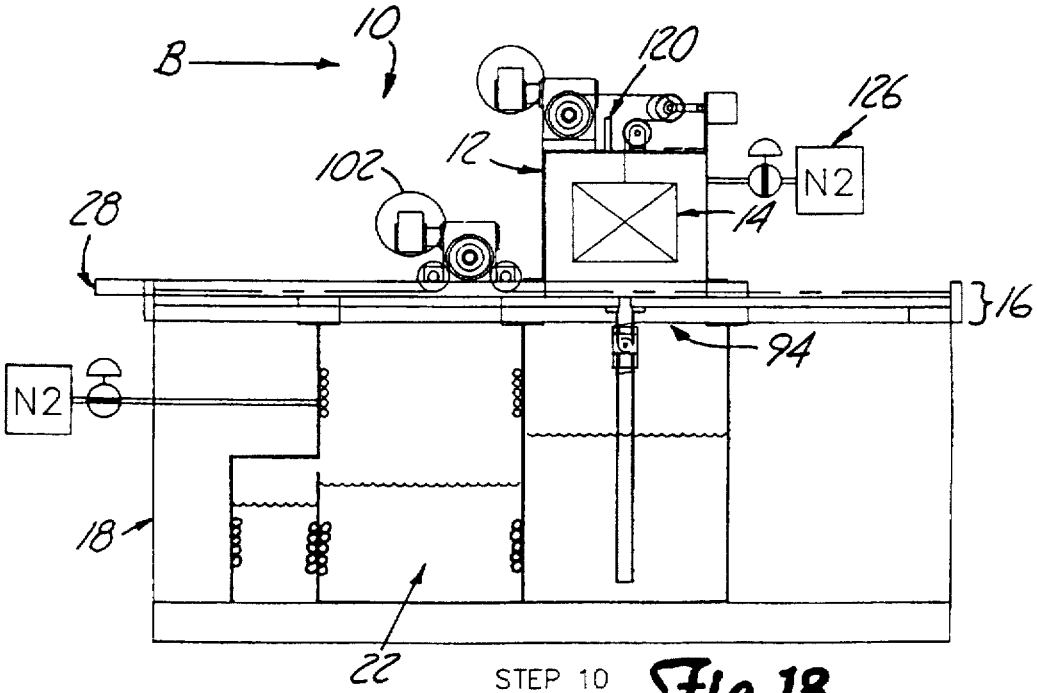
STEP 10 Fig. 13

STEP 11

HERMETIC ENCLOSURE FOR TREATING A WORKPIECE WITH A SOLVENT

BACKGROUND OF THE INVENTION

The present invention generally relates to an apparatus for treating a workpiece with a solvent. More specifically, the present invention relates to an automated system for treating a workpiece with an expensive, toxic, or flammable solvent in a hermetic enclosure.

There are a wide variety of available solvents for treating articles ranging from clothing to industrial workpieces. Many of these solvents are expensive, toxic, and/or flammable. Expensive solvents may cost as much as $220 or more per gallon. Toxic solvents may cause toxic effects to persons or animals exposed to the toxic solvent and may also impart toxic characteristics to natural resources, such as soil, water, and air. Special handling techniques are therefore desirable in treatment devices that employ expensive or toxic solvents to prevent losses of expensive or toxic solvents from the device. Certain mixtures of air and flammable solvent vapor are capable of exploding when exposed to an ignition source, such as a spark of static electricity. Therefore, treatment devices that employ flammable solvents should prevent formation of flammable solvent vapor or explosive mixtures of air and solvent vapor.

Techniques that employ a solvent for treating an article eventually allow the solvent to become contaminated with substances that are removed from the article. Additionally, substances that are not removed from the article may contaminate the solvent. For example, water derived from humid air may contaminate the solvent before, during, and/or after treatment of the article. Systems for treating articles with solvent should minimize or eliminate contamination of the treatment solvent with substances that are not removed from the articles, since it is expensive, time consuming, and disruptive to clean or replace contaminated solvents.

There are a number of existing devices and systems for treating articles using solvents. However, none of these existing devices and systems are truly capable of economically and safely employing expensive, toxic, or flammable solvents. Many of these systems are incapable of handling flammable solvents without undesireably forming an explosive air/solvent vapor mixture or releasing toxic or flammable solvent vapor to atmosphere. Also, many of these systems are incapable of using expensive, toxic, or flammable solvents without undue contamination of the solvent by condensed water from air. Additionally, many of these systems are batch in nature and are unsuitable for incorporation into automated manufacturing operations. Finally, many of these systems are relatively complicated and expensive to build, maintain, and operate.

One common example of an existing apparatus for cleaning workpieces with a solvent is an open top degreasing machine that employs alcohol as the cleaning solvent. The open top degreaser exposes the solvent and vapor from the solvent directly to atmosphere. The degreasing machine essentially consists of a rectangular basin having four sides and a bottom. The workpiece may be placed in the basin and soaked in the alcohol. Additionally, alcohol can be sprayed onto the workpiece in the basin.

Maintenance of adequate freeboard minimizes the amount of alcohol that spills from the basin. A cover is sometimes placed over the basin when the degreasing machine is not in use. However, the cover is not sealed against the basin.

Therefore, the open top degreaser exposes the solvent and vapor from the solvent directly to atmosphere. These open top degreasing machines thus emit solvent vapors through the open top, especially when parts are being cleaned.

Even if the cover is placed over the basin, solvent vapors are still emitted to atmosphere because of the unsealed nature of the cover. Areas near the degreasing machines are often ventilated in an attempt to reduce the risk of a fire. This ventilation does not remove the solvent vapor from the atmosphere, but instead merely dilutes the concentration of vapor in air. Furthermore, despite the ventilation efforts, an explosive or flammable vapor/air mixture typically remains at some point above the surface of the solvent liquid, either in or near the degreasing machine.

Other examples of some current systems for treating articles with solvent are processes that employ closed-loop recovery systems to recover cleaning solvents. Though the closed-loop systems often do satisfactorily clean the article, these systems have several undesirable characteristics. For example, the cleaning systems are incapable of handling flammable solvents without forming an explosive air/solvent vapor atmosphere. Also, many of these cleaning systems are batch in nature and therefore cannot be efficiently incorporated into an automated manufacturing operation.

Dry cleaning systems for cleaning clothing are one example of closed-loop recovery systems. Dry cleaning systems treat the clothing with a high boiling point solvent, such as perchloroethylene, and then remove the solvent from the clothing with application of heat and air. Because of perchloroethylene's high boiling point, the perchloroethylene can be efficiently recovered from the air within the system, via carbon adsorption or refrigeration, and recycled.

Despite this ability to recover the solvent, these dry cleaning systems have a number of disadvantages. For example, such systems typically have long cycle times and little operational flexibility. Also, these systems are not capable of economically handling production quantities of manufactured products. Additionally, these systems are not efficient when lower boiling point solvents are substituted for the high boiling point solvents.

Other types of closed-loop recovery systems employ a sealed chamber in which the workpiece is placed. In these systems, a vacuum pump is typically used to remove air from the chamber. Vacuum system leaks and the condition and ability of the vacuum pump sometimes undesireably limit the amount of air removal from the chamber. When the air removal is complete to the extent possible, the solvent is introduced into the chamber to remove oils and soil from the workpiece. The solvent is then drained from the chamber and the vacuum pump and/or air is used to remove any remaining solvent from the workpiece.

While such sealed chamber systems may work reasonably well when the solvent is perchloroethylene, these systems are much less efficient when lower boiling solvents are used. In fact, lower boiling solvents are typically not recommended for or used in these sealed chamber systems. Numerous citations in the technical literature attest to this incompatibility of lower boiling solvents with these sealed chamber systems.

Another problem is the effect these complicated sealed chamber systems have on the solvent. A major solvent manufacturer reports that these sealed chamber systems cause costly solvent breakdown which results in acid formation and equipment damage. Operation of these sealed chamber systems requires a complicated maze of equipment including piping, automatic valves, automatic dampers, pumps, heaters, seals, vacuum pumps, the vacuum chamber, refrigeration pumps, and carbon adsorption equipment.

Processing of the solvent through the complicated maze of equipment, along with the soil, oils, chips, and residues removed from the workpiece, cause solvent decomposition and acid formation. The solvent decomposition destroys cleaning productivity and the acid formation degrades the maze of equipment. Therefore, each time the solvent begins to decompose, the maze of equipment must be disassembled and cleaned. The cleaning efforts undesireably yield hazardous and toxic wastes that must be properly handled and disposed of at great cost. Additionally, since the maze of equipment is virtually impossible to fully disassemble and adequately clean, solvent breakdown and acid formation frequently recurs within a short period of time.

Beyond problems that directly relate to the solvent, sealed chamber systems such as these typically have a number of other drawbacks. For example, a relatively long period of time is typically needed to draw the vacuum and recover the solvent. Additionally, seal and component leaks often develop in these systems and inhibit solvent withdrawal. Beside slowing solvent recovery, the seal and component leaks must be repaired to prevent solvent loss from the chamber. Repairs of seal and component leaks cause undesirable system down time and maintenance expenses. The seal and component leaks also make it inadvisable to employ flammable solvents in the systems, since the leaks allow explosive mixtures of air and solvent vapor to form.

Though there are a number of devices and systems available that employ solvents for treating articles, none of these devices is capable of satisfactory, automated operation while safely and economically handling expensive, toxic, or flammable solvents. There is a need for an improved treatment device that is capable of employing expensive or toxic solvents while minimizing solvent contamination and losses. Furthermore, there is a need for an improved treatment device that is capable of employing flammable solvents without allowing formation of explosive air/solvent vapor mixtures.

SUMMARY OF THE INVENTION

The present invention pertains to an apparatus for treating a workpiece that includes a carriage for holding the workpiece, a first station for transferring the workpiece into and out of the carriage, a first chamber for holding treatment fluid, a second station for transferring the workpiece between the carriage and the first chamber, and a mechanism for staging the carriage. The mechanism for staging the carriage is capable of positioning the carriage at the first station and at the second station, and the first chamber is capable of being isolated from atmosphere when the carrier is located at the second station. The present invention also includes a method of treating a workpiece.

BRIEF DESCRIPTION OF THE DRAWINGS

FIG. 3*a* is an enlarged partial sectional side plan view of the treatment apparatus of the present invention.

FIG. 3*b* is a partial top plan view of the treatment apparatus of the present invention.

FIG. 10 is another schematic side plan view of the treatment apparatus of the present invention.

FIG. 11 is another schematic side plan view of the treatment apparatus of the present invention.

FIG. 12 is another schematic side plan view of the treatment apparatus of the present invention.

FIG. 13 is another schematic side plan view of the treatment apparatus of the present invention.

DETAILED DESCRIPTION OF THE PREFERRED EMBODIMENTS

Figure 1:
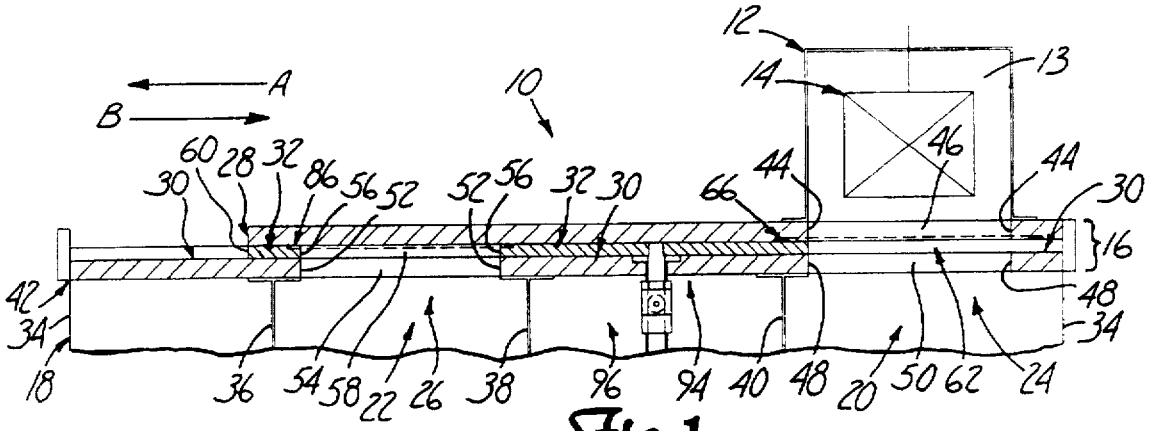
FIG. 1 is a sectional side plan view of the treatment apparatus of the present invention.
Figure 3:
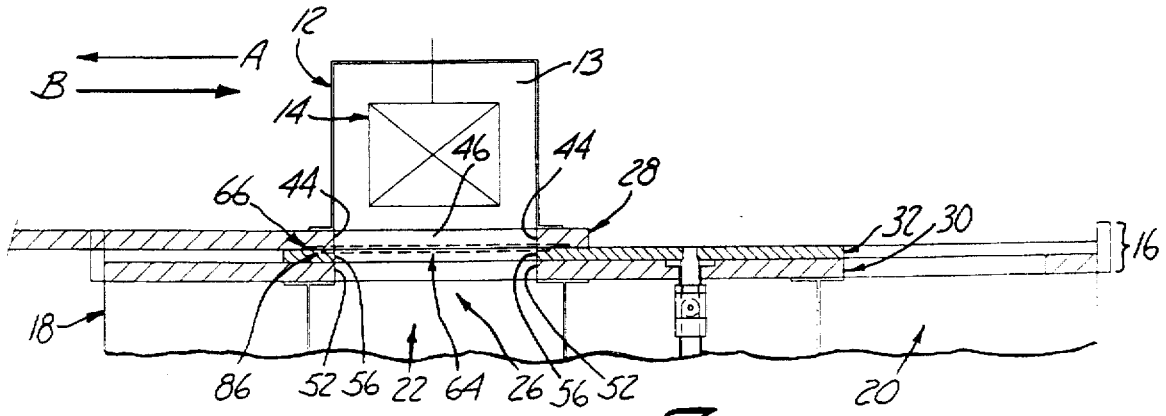
FIG. 3 is another sectional side plan view of the treatment apparatus of the present invention.

An apparatus of the present invention for treating an article in a hermetic environment is generally indicated at 10 in FIG. 1. The apparatus 10 includes a carriage 12 with a compartment or chamber 13 for holding a workpiece 14, such a basket of parts, an industrial item, or any other article capable of being treated with solvent. The apparatus 10 may be advantageously used to treat the workpiece 14 with solvent in a hermetic environment in accordance with the present invention. The apparatus 10 also includes a mechanism 16 for staging or positioning the carriage 12, a base 18 with a holding location 20 for the workpiece 14, and a chamber 22 for holding a treating fluid 23 (not shown in FIG. 1). The apparatus 10 further includes a station 24 for transferring the workpiece 14 between the holding location 20 and the carriage 12 and a station 26, as best depicted in FIG. 3, for transferring the workpiece 14 between the carriage 12 and the chamber 22.

The apparatus 10 of the present invention is an innovative and automated solution to the longstanding problem of how to safely and economically treat articles, such as the workpiece 14, with solvent. The simple structure of the apparatus 10 provides a secure hermetic treatment environment for safely treating the workpiece 14. Additionally, the simple structure of the apparatus 10 minimizes the cost of purchasing the apparatus 10 and minimizes the expense of operating and maintaining the apparatus 10. Also, the apparatus 10 substantially minimizes the amount of solvent that is consumed during the treating operation. For example, the apparatus 10 permits the amount of toxic or expensive solvent and air that mixes in the apparatus 10 to be minimized or eliminated and, thereby, minimizes or eliminates toxic or expensive solvent losses from the apparatus 10. The apparatus 10 also prevents the formation of a flammable or explosive mixture of solvent vapor and air. Thus, the apparatus 10 maintains a safe, non-explosive, working environment and eliminates flammable solvent losses from the apparatus 10, such as during venting, flaring, or vapor recovery operations. The apparatus 10 also prevents contamination of the treating solvent with water from humid air and thereby further reduces the frequency and complexity of solvent recycling operations.

Referring back to FIG. 1, the mechanism 16 for staging the carriage 12 includes a movable plate 28, a support plate 30, and a backing plate 32. The backing plate 32 is sandwiched between the movable plate 28 and the support plate 30. The base 18 of the apparatus 10 may include a pair of end walls 34 and internal walls 36, 38, and 40. The chamber 22 is located between the internal walls 36, 38 near the mechanism 16.

The support plate 30 is fixedly attached to an upper side 42 of the base 18, such as at upper ends (not shown) of the walls 34, 36, 38, 40. The backing plate 32 rests upon and is fixedly attached to the support plate 30. The movable plate 28 slidably rests upon or adjacent to the backing plate 32. The movable plate 28 may be selectively moved along the backing plate 32 in the direction of arrow A and arrow B using a suitable movement mechanism (not shown in FIG. 1). The movable plate 28 is prevented from sliding along the backing plate 32 in any direction other than the direction of arrow A and arrow B by suitable guide bracket or rollers (not shown) that are spaced along and fixed to front and back elongate sides (not shown) of the plate 30 and/or the plate 32.

The movable plate 28 includes an internal surface 44 that defines a circular opening 46 through the plate 28. The support plate 30 includes an internal surface 48 that defines a circular opening 50 through the plate 30. The support plate 30 also includes an internal surface 52 that defines a circular opening 54 through the plate 30. Additionally, the backing plate 32 includes an internal surface 56 that defines a circular opening 58 through the plate 32. The circular openings 46, 50, 54, and 58 each have the same diameter. The plate 28 may be positioned relative to an end 60 of the plate 32 and relative to the plates 30, 32, with the internal surface 44 and the internal surface 48 in alignment, to define an aperture 62 through the mechanism 16 at the station 24. Additionally, the plate 28 may be positioned relative to the plates 30, 32 with the internal surfaces 44, 52, 56 in alignment, as depicted in FIG. 3, to form an aperture 64 through the mechanism 16 at the station 26. Though the openings 46, 50, 54 and 58 are described as circular openings, it is to be understood that the openings 46, 50, 54, and 58 may be square, rectangular, triangular, or any other shape that permits the workpiece 14 to be transferred through the openings 46, 50, 54, 58 and the apertures 62, 64.

The plate 28 includes a sealing structure 66 that helps seal the chambers 13, 22 from atmosphere and helps maintain a hermetic environment within the chambers 13, 22. As best depicted in FIG. 3a, the sealing structure 66 has a pair of o-rings 68, 70. The plate 28 has an internal surface 72 that faces the plate 32. The internal surface 72 defines a pair of radial grooves 74, 76 in the plate 28. The grooves 74, 76 surround the circular opening 46 through the plate 28, and the groove 74 is positioned between the groove 76 and the opening 46, as in FIG. 3*b*. The o-ring 68 is positioned within the radial groove 74, and the o-ring 70 is positioned within the radial groove 76. Referring back to FIG. 3*a*, the o-rings 68, 70 extend slightly beyond a lower surface 78 of the plate 28 and into contact with an upper surface 80 of the plate 32. The lower surface 78 of the plate 28 faces the upper surface 80 of the plate 32.

With the plate 28 resting adjacent to the plate 32, the o-rings 68, 70, the lower surface 78 of the plate 28, and the upper surface 80 of the plate 32 define a radial cavity 82. The mechanism 16 may include a conduit 84 that extends through the plate 28 and is in fluid communication with the cavity 82. The conduit 84 may be connected to a suitable vacuum source (not shown) for pulling a vacuum on the cavity 82, for drawing the rings 68, 70 into tighter contact with the plates 28, 32, and for drawing the plate 28 into contact with the plate 32 proximate the rings 68, 70. Additionally, the mechanism 16 may include an exhaust pipe 85 that extends through the plate 28 and allows the cavity 82 to be selectively placed in fluid communication with the atmosphere. A source of inert gas (not shown), such as nitrogen, may be attached to the conduit 84 to flush any fluid substance contained in the cavity 82 to atmosphere via the exhaust pipe 85.

The plate 32 may similarly include a sealing structure 86 that helps seal the chambers 13, 22 from atmosphere and helps maintain a hermetic environment within the chambers 13, 22. The sealing structure 86 incorporates an o-ring 88. The plate 32 has an internal surface 90 that faces the plate 28 and defines a radial groove 92. The groove 92 is spaced about the opening 58 of the plate 32. The o-ring 88 may be placed within the groove 92 so that the plate 32 rests in sealing contact against the o-ring 88.

Figure 2:
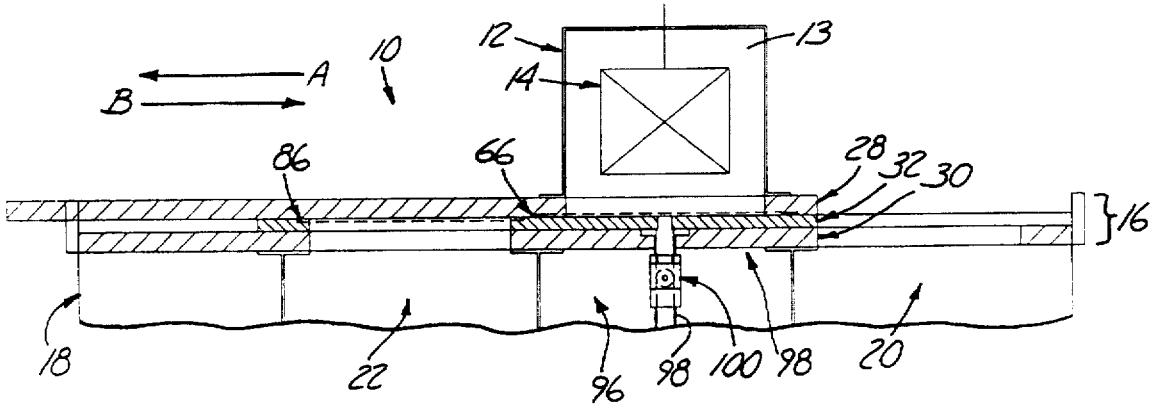
FIG. 2 is another sectional side plan view of the treatment apparatus of the present invention.

Referring back to FIG. 1, the apparatus 10 may optionally include a sump 94 that is located between the holding location 20 and the chamber 22. The apparatus 10 may optionally also include a station 96, between the station 24 and the station 26, for accessing the sump 94. A conduit 98 may extend from the sump 94 through the plates 30, 32 to place the sump 94 in fluid communication with the chamber 13 of the carriage 12 when the opening 48 of the plate 28 is positioned above the sump 94, as best depicted in FIG. 2. The apparatus 10 may also include a pump 100 that is operably connected to the conduit 98 for transferring a liquid (not shown) from the sump 96 into the chamber 13. The conduit 98 may also incorporate a suitable valve or valves (not shown) to permit the fluid to be selectively retained in the chamber 13 without draining or seeping back into the sump 96. The apparatus may also include a return line (not shown) with a suitable valve (not shown) for selectively transferring the liquid from the chamber 13 back into the sump 96.

It is to be understood that treating means any workpiece manipulation that incorporates solvent, including, but not limited to, coating, etching, cleaning, stripping, disinfecting, and sterilizing. The method of operating the apparatus 10 for treating the workpiece 14, involves a number of steps that are schematically depicted in FIGS. 4–14. The carriage 12 may be positioned at the station 24 using a suitable chain drive mechanism 102, as in FIG. 4, to allow transfer of the workpiece 14 between the holding location 20 and the carriage 12. The chain drive mechanism 102 includes a motor and drive gear assembly 104 that is fixedly attached to the movable plate 28. The chain drive mechanism 102 also includes a chain 106 that is fixedly attached to the base 18 at end supports 108 of the base 18. The chain 106 extends between the end supports 108 and the motor and drive gear assembly 104 engages the chain 106. The motor and drive gear assembly 104 may be selectively moved along the chain 106 in either the direction of arrow A or arrow B.

The apparatus 10 also includes a hoist mechanism 110 for transferring the workpiece 14 into and out of the chamber 13. The hoist mechanism 110 includes a motor and drive gear assembly 112 that is attached to the carriage 12. The hoist mechanism 110 also includes a cable 114 that is attached to a reel 115 of the assembly 112. The hoist mechanism 110 further includes a pair of pulleys 116 that are attached to the carriage 12 and permit the cable 114 to travel in the direction of either arrow C or arrow D in and below the chamber 13. With the cable 114 attached to the workpiece 14, the motor and reel assembly 112 may be activated to either lift the workpiece 14 in the direction of arrow C into the carriage 12 or to lower the workpiece 14 out of the carriage 12 in the direction of arrow D.

Figure 5:
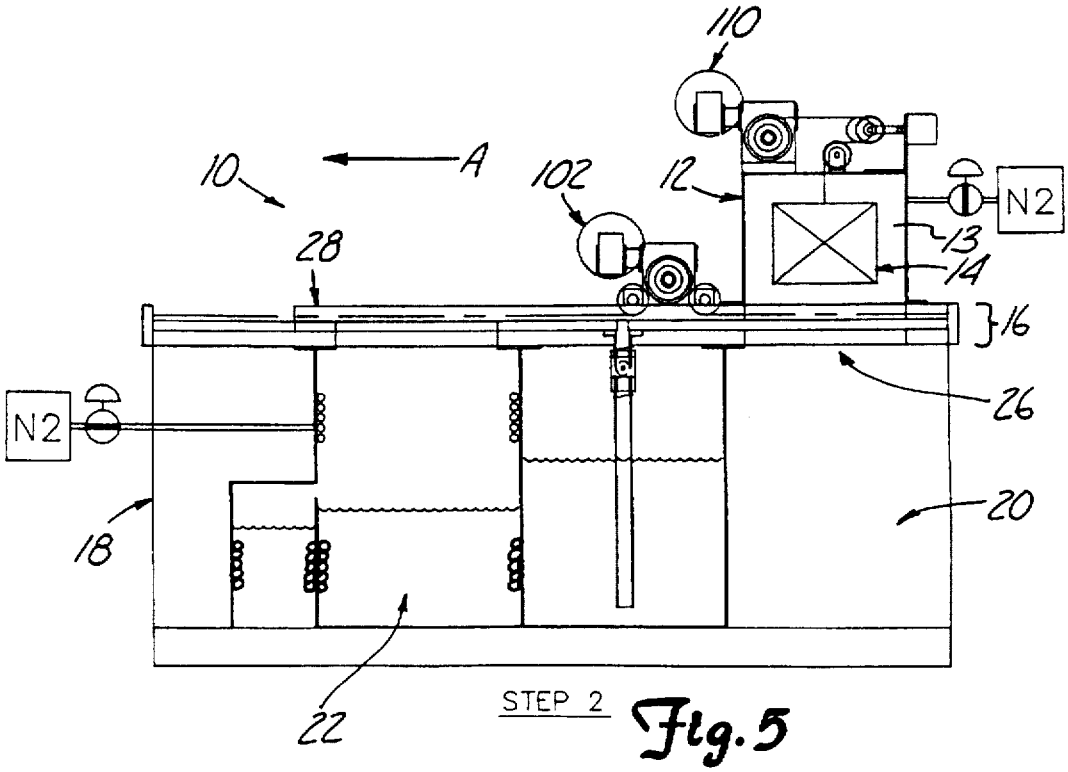
FIG. 5 is another schematic side plan view of the treatment apparatus of the present invention.

When preparing an article, such as the workpiece 14, for treating in the apparatus 10, the carriage 12 is first positioned at the station 24 using the drive mechanism 102. Then, the workpiece 14 is transferred from the loading position 20 through the aperture 62 and into the chamber 13, as best depicted in FIG. 5. The workpiece may be provided at the holding location 20 either manually or via a conveyer (not shown). Suitable controls may be provided to link and automate the operation of the conveyer, the drive mechanism 102, and the hoist mechanism 110.

Figure 6:
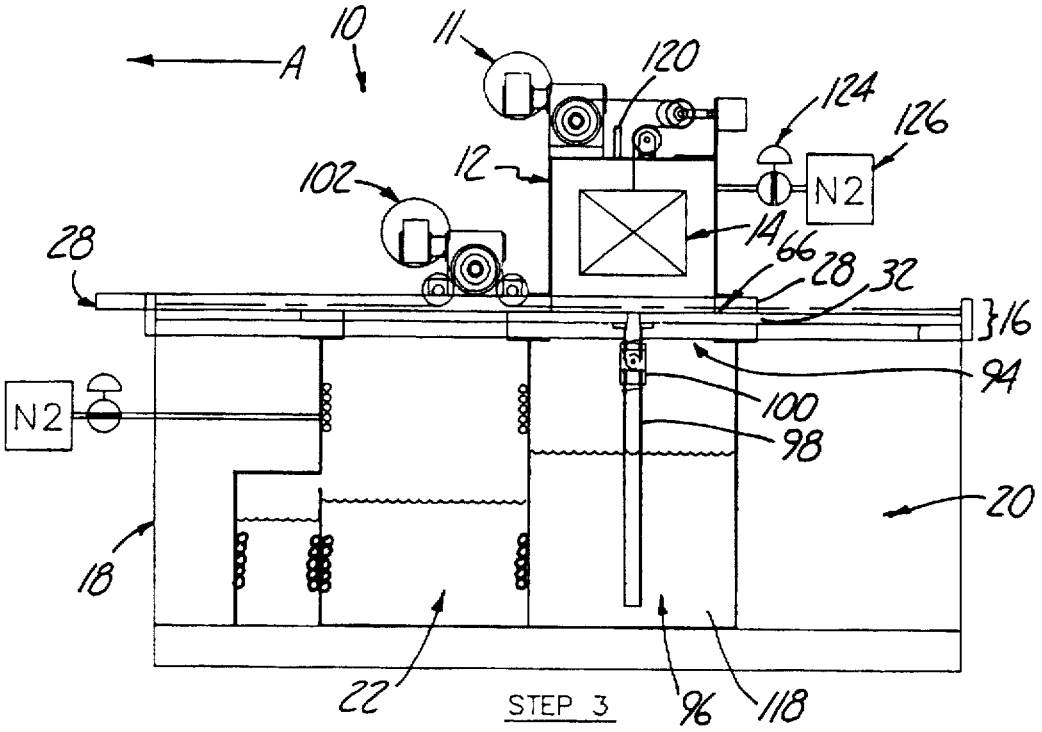
FIG. 6 is another schematic side plan view of the treatment apparatus of the present invention.

After the workpiece 14 is loaded into the chamber 13, the drive mechanism 102 may be activated to move the carriage 12 to the station 94 associated with the sump 96, as depicted in FIG. 6. With the carriage 12 positioned at the station 94, the o-rings 68, 70 of the sealing structure 66 are engaged between the plates 28, 32 to isolate the chamber 13 from the atmosphere.

The source of vacuum may be connected to the conduit 84 (not shown in FIG. 6) to pull a vacuum on the cavity 82 (not shown in FIG. 6), draw the rings 68, 70 (not shown in FIG. 6) into tighter contact with the plates 28, 32, and draw the plate 28 into contact with the plate 32 proximate the rings 68, 70. The vacuum on the cavity 82 enhances the sealing action of the sealing structure 66 and thereby helps prevent air from entering the chamber 13 and helps prevent fluid from leaking out of the chamber 13. It is to be understood that the sealing structure 66 provides a substantial amount of sealing action that maintains the hermetic environment in chamber 13, even absent placing the cavity 82 under vacuum. As another alternative, the source of nitrogen may be attached to the conduit 84 to flush any fluid substance, such as air, contained in the cavity 82 to atmosphere via the exhaust pipe 85 (not shown in FIG. 6), and help prevent air from entering the chamber 13.

Figure 7:
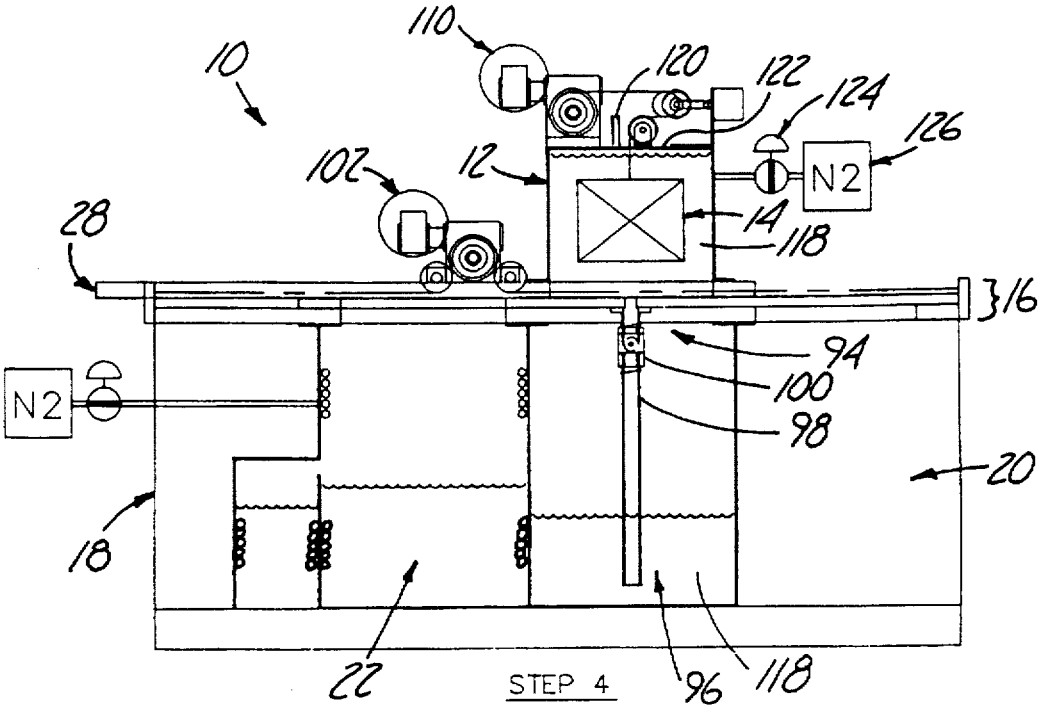
FIG. 7 is another schematic side plan view of the treatment apparatus of the present invention.

A number of alternative actions may take place at the station 94. First, a suitable pre-treatment fluid 118, such as water or an organic solvent, may be placed in the sump 96. The fluid 118 may be pumped into the chamber 13 using the pump 100 and the conduit 98. As the fluid 118 fills the chamber 13, the fluid 118 forces air from the chamber 13 to atmosphere through a conduit and valve assembly 120 that is attached to a top 122 of the carriage 12, as best depicted in FIG. 7.

Figure 8:
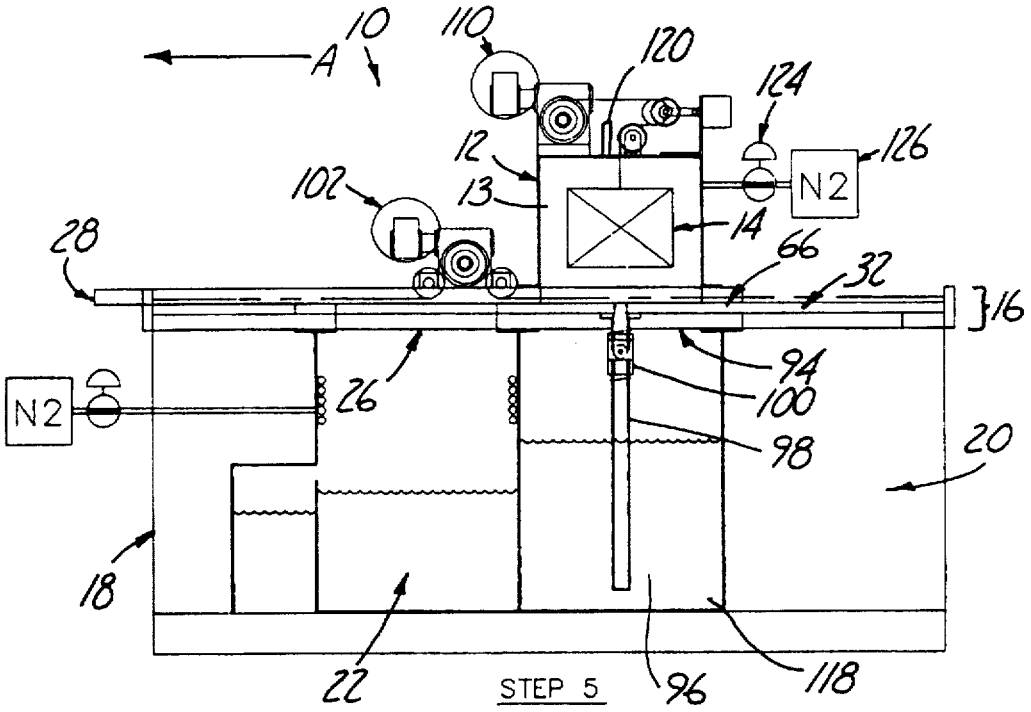
FIG. 8 is another schematic side plan view of the treatment apparatus of the present invention.

After the fluid 118 has completed pre-treatment of the workpiece 14, the fluid 118 may be drained from the chamber 13 into the sump 96, as depicted in FIG. 8, through the return line (not shown) or through the conduit 98. When the fluid 118 is being transferred from the chamber 13 into the sump 96, the conduit and valve assembly 120 may be closed, and the chamber 13 may be blanketed with an inert gas, such as nitrogen, via a conduit and valve assembly 124 that is attached to a source 126 of inert gas. Placement of the valve assembly 120 in the closed position, in combination with the sealing action of the seal structure 66, prevents air from entering the chamber 13 while the chamber 13 is being blanketed with the inert gas. Blanketing the chamber 13 with the inert gas serves at least two purposes. First, the inert gas helps prevent the formation of a flammable or explosive mixture of solvent vapor and air, if the fluid 118 is or contains a flammable solvent. Additionally, the inert gas blanket prevents the introduction of humid air into the chamber 13. Eliminating humid air from the chamber 13 helps prevent water contained in the humid air from becoming mixed with treating fluid in the chamber 22 later in the treatment process.

Alternatively, when a flammable solvent or fluid is not included in the chamber 22 or the sump 96, the fluid 118 may be transferred from the carriage 13 into the sump 96 while permitting air to enter the carriage 13 through the assembly 120 without blanketing the carriage 13 with nitrogen. The vacuum is preferably still drawn on the cavity 82 to enhance the sealing action of the seal structure 66 and help prevent the fluid 118 from leaking out of the chamber 13. Again, air should not be allowed to enter the chamber 13 when the fluid 118 is or contains a flammable solvent or when the chamber 22 contains a flammable solvent since a flammable or explosive mixture of air and solvent vapor could then occur in the carriage 13, the sump 96, or the chamber 22.

Other alternative uses of the station 94 are envisioned. For example, the fluid 118 could be pumped into the carriage 13 from a source (not shown) other than the sump 96, and could be drained from the carriage 13 into a receptacle (not shown) other than the sump 96. As another alternative, the station 94 could be outfitted with a transfer aperture (not shown) similar to the aperture 64 (not shown in FIG. 8) located at station 26. The transfer aperture would replace the conduit 98, the pump 100, and the return line. With this structure, the hoist mechanism 110 could be used to lower the workpiece 14 through the aperture and into the fluid 118 for pre-treating and to raise the workpiece 14 back into the chamber 13 upon completion of pre-treatment. After raising the workpiece 14 back into the chamber 13, air could be permitted to remain in the chamber 13, if a flammable solvent is not used in the apparatus 10, or the source 126 could be activated to purge air from the chamber 13 through the conduit and valve assembly 120 and leave the chamber 13 blanketed in inert gas, such as nitrogen.

In yet another alternative for station 94, the step of pre-treating the workpiece 14 with the fluid 118, as in FIG. 7, could be skipped. If flammable solvent is present in the sump 22, or elsewhere in the apparatus 10, the carriage 12 could still be positioned at station 26, and the source 126 of nitrogen could be activated to purge air from the chamber 13 through the conduit and valve assembly 120, as in FIG. 8. If flammable solvent is not present in the sump 22 or elsewhere in the apparatus 26, the carriage 12 could be moved from the station 26, as depicted in FIG. 5, directly to the station 26, as depicted in FIG. 9, without stopping at the station 94.

The carriage 12 may be moved to the station 26 from either the station 24 or the station 94 using the drive mechanism 102. The sealing action of the sealing structure 66 isolates the chamber 13 from atmosphere during movement of the carriage 12 when all of the circular opening 46 overlaps the backing plate 32 and the entire length of at least the o-ring 68 is in contact with the backing plate 32. The sealing action of the sealing structure 86 isolates the chamber 22 from atmosphere during movement of the carriage 12 when all portions of the circular openings 54, 58 overlap the positioning plate 28 and the entire length of the o-ring 88 is in contact with the positioning plate 28. The combined sealing action of the sealing structures 66, 86 isolates the chamber 13 and the chamber 22 from atmosphere during movement of the carriage 12 when any part of the o-ring 68 overlaps the circular openings 54, 58 and when any part of the o-ring 88 overlaps the circular opening 46. Thus, the sealing structure 66 and the sealing structure 86, either separately or in combination depending upon the position of the plate 28 relative to the plate 32, isolate the chambers 13, 22 from atmosphere and maintain any nitrogen blanket in the chambers 13, 22 during movement of the plate 28.

Figure 9:
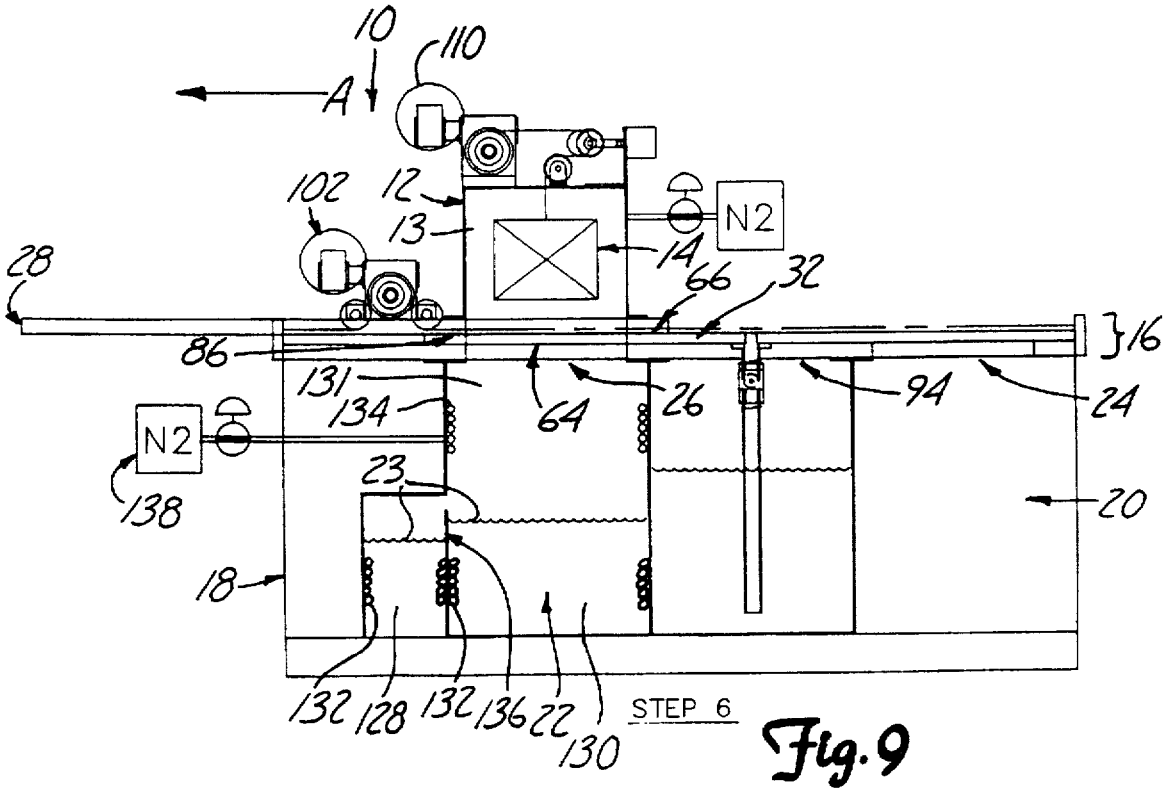
FIG. 9 is another schematic side plan view of the treatment apparatus of the present invention.

The chamber 22 at the station 26 may, as depicted in FIG. 9, include both a small sump 128 and a large sump 130 that each contain the treating fluid 23. Examples of the treating fluid 23 include solvents that may be toxic, flammable, and/or expensive. The sump 130 includes a vapor space 131, and the sumps 128, 130 each include heating coils 132. Additionally, the sump 130 includes condenser coils 134. A baffle 136 separates the sumps 128, 130. The baffle 136 permits the fluid 23 in the sump 130 to overflow into the sump 128, while also permitting any vapor coming from the treating fluid 23 in the sump 128 to flow into the vapor space 131.

The sump 128 and the heating coils 132 located in the sump 128 are sized to heat the fluid 23 in the sump 128 more quickly than the fluid 23 is heated in the sump 130. Vapor liberated from the fluid 23 in the sump 128 flows into the vapor space 131 of the sump 130 along with vapors liberated from the fluid 23 that is located in the sump 130. Solvent vapor in the vapor space 131 is condensed by the condenser coils 134 and falls back into the sump 130 in liquid form. The condenser coils 134 also condense any water vapor in air that is present in the chamber 22. The condensed water falls into and contaminates the fluid 23 and hastens the need to remove contaminants from the fluid 23. To prevent air-borne water from contaminating the fluid 23, it is important to maintain the chamber 13 free of air that contains water and blanketed in inert gas, such as nitrogen, when the chamber 13 is moved into position over the chamber 22.

The sump 130 may be attached to a source 138 of nitrogen that purges air from the chamber 22 through a vent (not shown) and maintains a nitrogen rich environment in the chamber 22. The nitrogen rich environment in the chamber 22 precludes formation of a flammable or explosive vapor/air mixture in the chamber 22 when the fluid 23 is or contains a flammable solvent. The nitrogen-rich environment in the chamber 22 also eliminates another source of air-borne water that could contaminate the fluid 23.

When the chamber 13 is blanketed with nitrogen at the station 94, the contact between the o-rings 68, 70 of the sealing structure 66 and the contact between the o-ring seal 92 of the sealing structure 86 and the plates 28, 32 hermetically seals the chamber 13 from the atmosphere during movement of the carriage 12 from the station 94 to the station 26 and while the carriage 12 is located at the station 26. Additionally, when the chambers 13 are blanketed in nitrogen, the seal structures 66, 86 hermetically seal the chamber 22 and prevent air from being introduced into the chamber 22 during movement of the carriage 12 from the station 94 to the station 26 and while the carriage 12 is located at the station 26.

The source of vacuum may be connected to the conduit 84 (not shown in FIG. 9) to pull a vacuum on the cavity 82 (not shown in FIG. 9), draw the rings 68, 70 (not shown in FIG. 9) into tighter contact with the plates 28, 32, and draw the plate 28 into contact with the plate 32 proximate the rings 68, 70. The vacuum on the cavity 82 enhances the sealing action of the sealing structure 66 and thereby helps prevent air from entering the chambers 13, 22 and helps prevent solvent vapor fluid from leaking out of the chambers 13, 22. It is to be understood that the sealing structure 66 provides a substantial amount of sealing action even absent placing the cavity 82 under vacuum. As another alternative, the source of nitrogen may be attached to the conduit 84 to flush any fluid substance, such as air, contained in the cavity 82 to atmosphere via the exhaust pipe 85 (not shown in FIG. 9), and help prevent air from entering the chambers 13, 22.

When the carriage 12 is located at the station 26, the hoist mechanism 110 may be activated to lower the workpiece 14 in the direction of arrow E from the chamber 13 through the aperture 64 and into the fluid 23 contained in the sump 130, as depicted in FIG. 10. After the solvent 23 has suitably treated the workpiece 14, the hoist mechanism 110 may be activated to lift the workpiece 14 out of the solvent 23 in the direction of arrow F, as depicted in FIG. 11, through the aperture 64, and into the chamber 13, as depicted in FIG. 12.

During the lowering of the workpiece into the fluid 23, the treatment of the workpiece by the fluid 23, and the retrieval of the workpiece from the fluid 23 into the chamber 22, the seal structures 66, 86 isolate the chamber 13 and the chamber 22 from atmosphere. Thus, if the chamber 13 and the chamber 22 were blanketed in nitrogen upon the arrival of the carriage 12 at the stage 26, the seal structures 66, 86 maintain the integrity of the nitrogen blanket in the chambers 13, 22 throughout the treatment process at the station 26.

Figure 14:
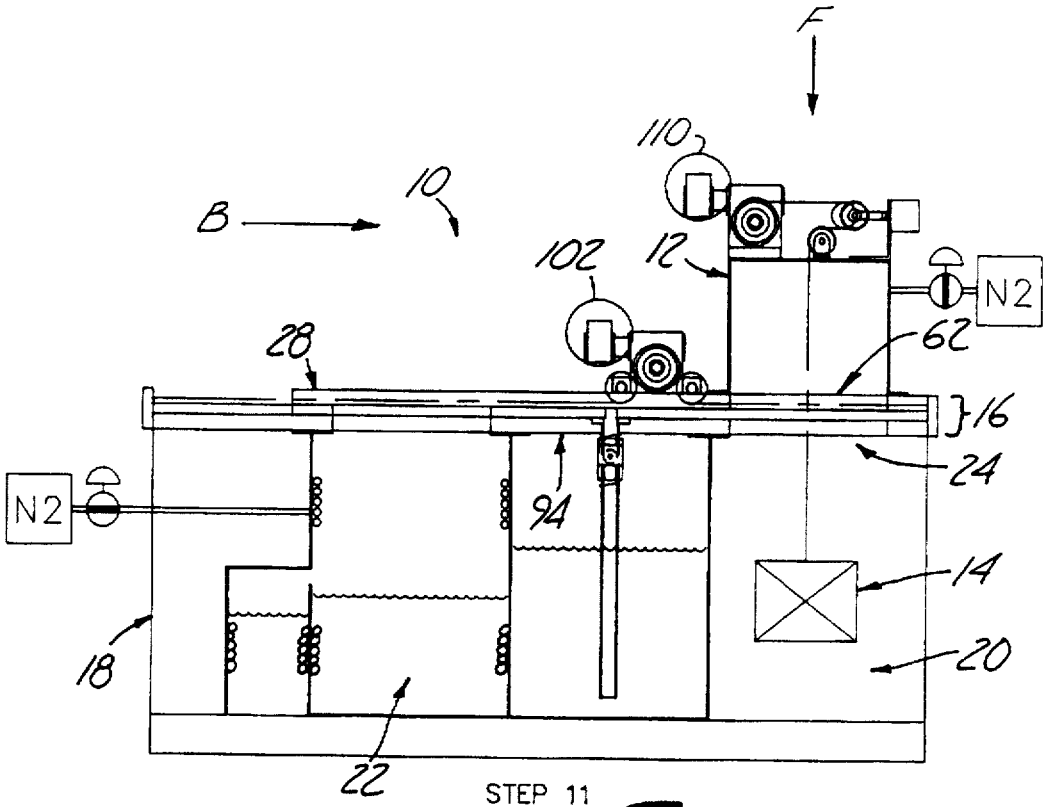
FIG. 14 is another schematic side plan view of the treatment apparatus of the present invention.

After the workpiece 14 is treated at the station 26, the drive mechanism 102 may be activated to move the carriage 12 in the direction of arrow B from the station 26 to the station 94, as in FIG. 13, or directly to the station 24, as in FIG. 14, without stopping at station 94. While moving the carriage 12 from the station 26 to either the station 94 or the station 24, the seal structures 66, 86 isolate the chambers 13, 22 from atmosphere and maintain the integrity of any nitrogen blanket in the chambers 13, 22 when the o-rings 68, 88 overlap to any extent. When the openings 46, 58 do not overlap, the sealing structure 66 isolates the chamber 13 from atmosphere and maintains the integrity of any nitrogen blanket within the chamber 13, as long as the entire length of at least the o-ring 68 is in contact with the backing plate 32, and the sealing structure 86 isolates the chamber 22 from atmosphere and maintains the integrity of any nitrogen blanket within the chamber 22.

If the carriage 12 is moved to the station 94, as in FIG. 13, the chamber 13 may be evacuated via the conduit and valve assembly 120 to atmosphere, to a flare (not shown) to incinerate any solvent vapor contained in the chamber 13, or to a solvent recovery system (not shown) to recover any solvent vapor contained in the chamber 13. Examples of the solvent recovery system include refrigerated recovery systems and carbon absorption recovery systems, as well as, any other type of solvent recovery system. While evacuating the chamber 13, air or nitrogen may be introduced into the chamber 13. If the chamber 13 contains any flammable solvent vapor, the chamber 13 is preferably blanketed with nitrogen introduced from the source 126, during evacuation of the chamber 13, to prevent the formation of a flammable or explosive solvent vapor/air mixture in the chamber 13.

As mentioned, the drive mechanism 102 may be activated to move the carriage 12 from the station 26 to the station 94, as in FIG. 13, or may be activated to move the carriage 12 directly from the station 26 to the station 24, as in FIG. 14, without stopping at the station 94. Preferably, when any expensive, toxic, or flammable solvent is included in the treating fluid 23 or the fluid 118, the carriage 12 does stop at the station 94. This permits flaring or recovery of any flammable solvent in the chamber 13 and recovery of any expensive or toxic solvent in the chamber 13.

At the station 24, the hoist mechanism 110 may be activated to lower the workpiece 14 in the direction of arrow F from the carriage 13 through the aperture 62 and to the holding location 20. At the holding location 20, the workpiece 14 may be either manually removed from the apparatus 10 or may be automatically removed from the apparatus 10 via the conveyer (not shown).

Figure 15:
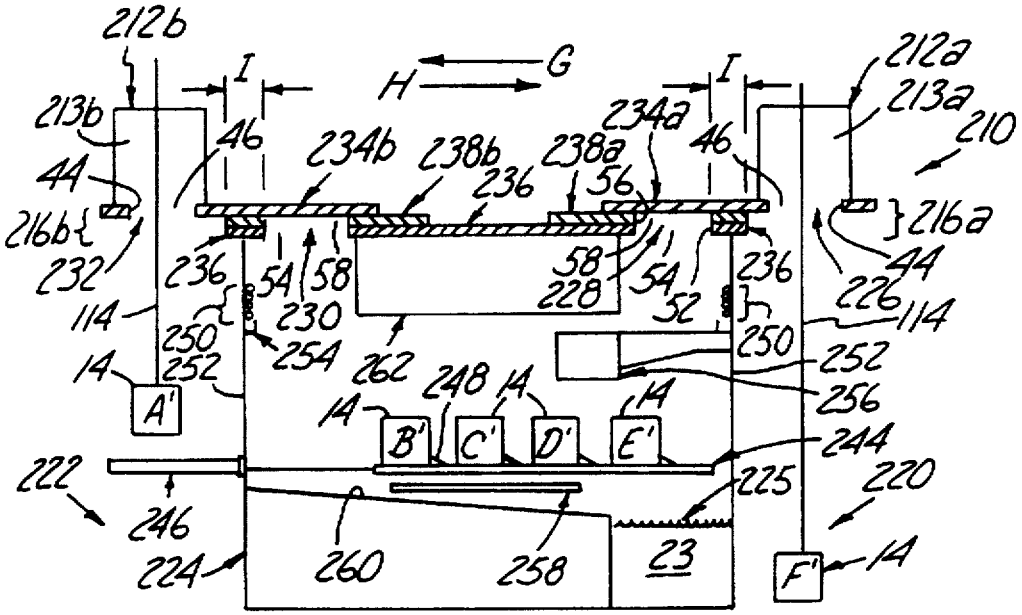
FIG. 15 is a sectional side plan view of another embodiment of the treatment apparatus of the present invention.

Another version of the apparatus of the present invention for treating an article in a hermetic environment is generally indicated at 210 in FIG. 15. The apparatus 210 may include carriages 212*a*, 212*b* with respective chambers 213*a*, 213*b* for holding workpieces 14. The apparatus 210 may be advantageously used to treat the workpieces 14 with solvent in a hermetic environment in accordance with the present invention. The apparatus 210 also includes mechanisms 216*a*, 216*b* for staging or positioning the carriages 212*a*, 212*b*. The apparatus 210 also includes a location 220 for loading workpieces 14 into the chamber 213*a* and a location 222 for unloading workpieces 14 from chamber 213*b*. The apparatus 210 further includes a chamber 224 in which workpieces 14 are treated with fluid 23 and a sump 225 that holds fluid 23 within the chamber 224. The apparatus 210 additionally includes a station 226 for transferring the workpiece 14 between the loading location 220 and the carriage 212*a*, a station 228 for transferring the workpiece 14 between the carriage 212*a* and the chamber 224, a station 230 for transferring the workpiece 14 between the chamber 224 and the carriage 212*b*, and a station 232 for transferring the workpiece 14 between the carriage 212*b* and the unloading location 222.

The mechanisms 216*a*, 216*b* for staging the carriages 212*a*, 212*b* include respective movable plates 234*a*, 234*b*, share a support plate 236, and include respective backing plates 238*a*, 238*b*. The backing plate 238*a* is sandwiched between the movable plate 234*a* and the support plate 236, and the backing plate 238*b* is sandwiched between the movable plate 234*b* and the support plate 236. The support plate 236 is fixedly attached to the top of the chamber 224. The backing plates 238*a*, 238*b* rest upon and are fixedly attached to the support plate 236. The movable plates 234*a*, 234*b* slidably rest upon or adjacent to the backing plates 238*a*, 238*b*, respectively.

The movable plates 234*a*, 234*b* may be selectively moved along backing plates 238*a*, 238*b*, respectively, in the direction of arrow G and arrow H using suitable movement mechanisms (not shown), such as chain, belt, or gear drives. The movable plates 234*a*, 234*b* are prevented from sliding along the backing plate 238*a*, 238*b* in any direction other than the direction of arrows G, H by suitable guide brackets or rollers (not shown) that are spaced along and fixed to front and back elongate sides (not shown) of the plates 238*a*, 238*b* and/or the plate 236.

The movable plate 234*a* includes the internal surface 44 that defines the circular opening 46 through the plate 234*a*. The support plate 236 includes the internal surface 52 that defines the circular opening 54 through the plate 236. Additionally, the backing plate 238a includes the internal surface 56 that defines the circular opening 58 through the plate 238*a*. The circular openings 46, 54, and 58 each have the same diameter. Though not shown in FIG. 15, it is to be understood that plates 234*b*, 238*b* and 236, proximate plates 234*b*, 238*b*, also include internal surfaces that define circular openings 46, 54, 58 through plates 234*b*, 236 (proximate plates 234*b*, 238*b*), and 238*b*, respectively.

Figure 16:
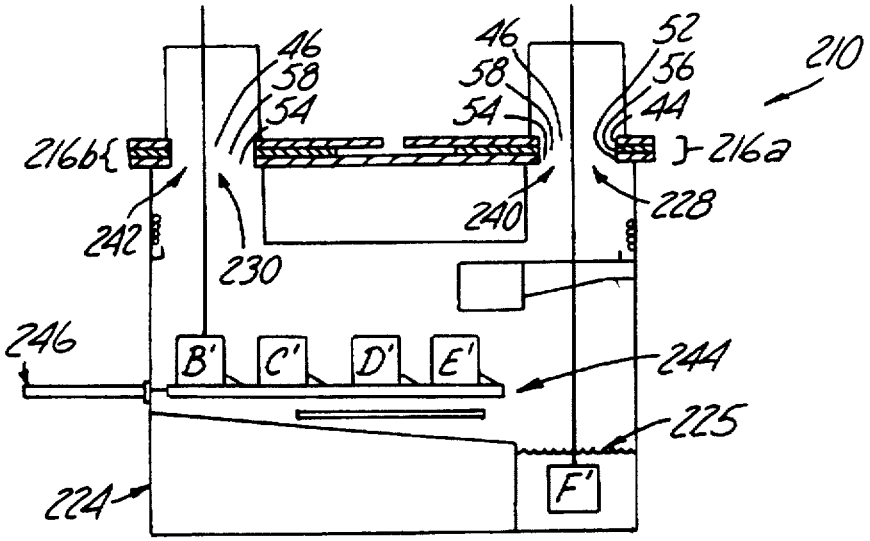
FIG. 16 is another sectional side plan view of another embodiment of the treatment apparatus of the present invention.

As best depicted in FIG. 16, the plate 234*a* may be positioned relative to the plates 236, 238*a*, with the internal surfaces 44, 52, 56 in alignment, to define an aperture 240 through the mechanism 216*a* at the station 228. The plate 234*b* may be positioned relative to the plates 236, 238*b*, with the internal surfaces (not shown) in alignment, to define an aperture 242 through the mechanism 216*b* at the station 230. Though the openings 46, 54 and 58 are described as circular openings, it is to be understood that the openings 46, 54, and 58 may be square, rectangular, triangular, or any other shape that permits workpieces 14 to be transferred through the openings 46, 54, and 58 and the apertures 240, 242.

The plates 234*a*, 234*b* each include one of the sealing structures 66 (not shown in FIGS. 15–18), and the plates 238*a*, 238*b* each include one of the sealing structures 86 (not shown in FIGS. 15–18). When the sealing structures 66, 86 are employed in the apparatus 210, it will be understood that previous references to the plates 28, 30, 32 and the mechanism 16 in the discussion of the structure, assembly, and operation of the structures 66, 86 instead refer to plates 234*a*, 234*b*, 238*a*, 238*b*, 236, and mechanisms 216*a*, 216*b*, respectively. From the previous discussion of the sealing structures 66, 86, in connection with the apparatus 10, it will be understood that the sealing structures 66, 86 help seal the chamber 224 from atmosphere and maintain a hermetic environment within the chamber 224. Additionally, when the chambers 213*a*, 213*b* are, or have been, in communication with the chamber 224, and before the chambers 213*a*, 213*b* are placed back into communication with atmosphere, it will be understood that the sealing structures 66, 86 help seal the chambers 213*a*, 213*b* from atmosphere and maintain a hermetic environment within the chambers 213*a*, 213*b*.

Figure 4:
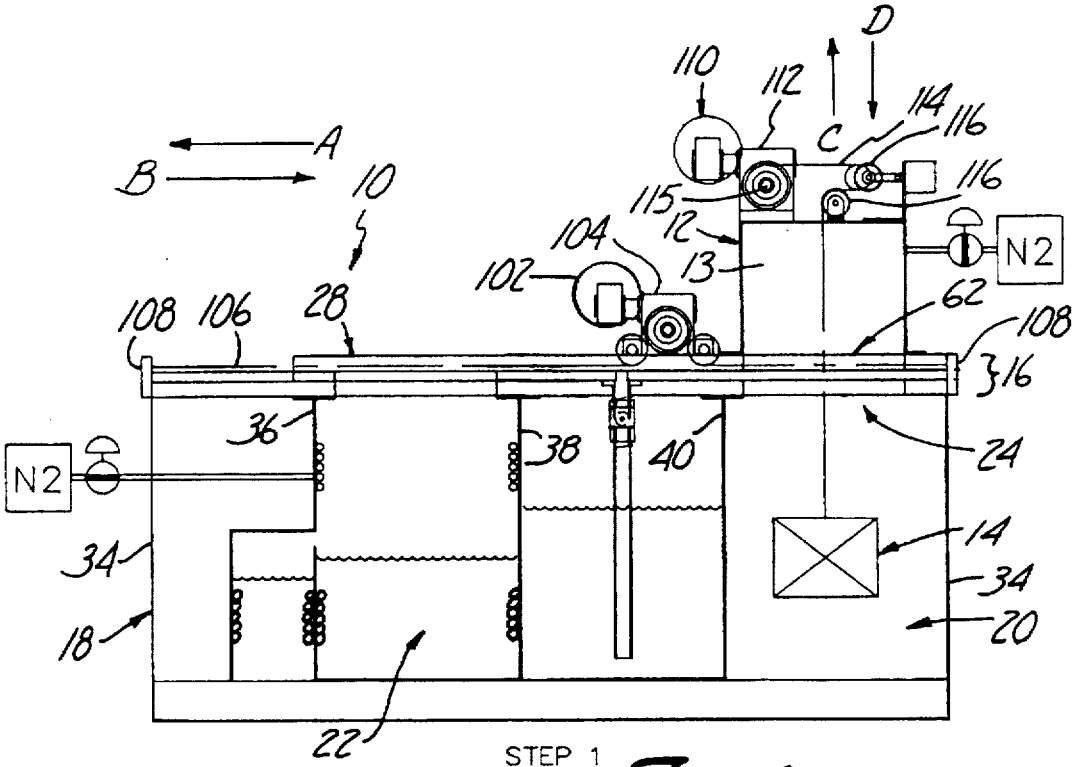
FIG. 4 is a schematic side plan view of the treatment apparatus of the present invention.

The apparatus 210 also includes hoist mechanisms (not shown) for transferring workpieces 14 into and out of the chambers 213*a*, 213*b*. The hoist mechanisms associated with the chambers 213*a*, 213*b* may be structured like the hoist mechanism 110 of the apparatus 10, as best depicted in FIG. 4. The hoist mechanisms may be attached to workpieces 14 using cable 114, as best depicted in FIG. 15.

Rather than the carriages 212*a*, 212*b*, and mechanisms 216*a*, 216*b*, the apparatus 210 may instead alternatively include the mechanism 16 and the carriage 12 of the apparatus 10. Of course, the mechanism 16 would be modified, as compared to the structure of the mechanism 16 used in the apparatus 10, to include only the apertures 240, 242 while permitting the carriage 12 to move between the stations 226, 228, 230, and 232. Nonetheless, the version of the apparatus 210 that includes the carriages 212*a*, 212*b*, and mechanisms 216*a*, 216*b* is preferred because mechanisms 216*a*, 216*b* permit simultaneous and independent operation of the carriages 212*a*, 212*b* to yield desirable operational flexibilities and efficiencies.

Besides the sump 225, the chamber 224 includes a number of other structural and operational features that aid in treating the workpieces 14 with the fluid 23. For example, the chamber 224 includes a carriage 244 for holding the workpieces above the sump 225 and for moving workpieces 14 within the chamber 224. The carriage 244 is connected to a linear actuator 246 that is capable of moving the carriage 244 in the direction of arrows G and H within the chamber 224. The carriage 244 also includes a conveying mechanism (not shown), such as a drag conveyor with catches 248, for moving workpieces 14 located on the carriage 244 relative to the carriage 244 in the direction of arrow G.

The chamber 224 also includes a plurality of condenser coils 250 attached to perimeter walls 252 of the chamber 224 near the top of the chamber 224. A condensate trough 254 is located immediately below the coils 250 to catch condensed treatment fluid vapor effected by the coils 250. The trough 254 is slightly sloped to permit treatment fluid entering the trough 254 to flow into a catch basin 256 that is located immediately above the carriage 244. A pump and spray mechanism (not shown) may be attached to the catch basin 256. The pump and spray mechanism may be used to shower workpieces 14 located on the carriage 244 with a secondary wash after the workpieces 14 have been treated in the sump 225. Alternatively, workpieces 14 may be treated with the treating fluid supplied by the pump and spray mechanism without treating the workpieces in the sump 225.

Heating coils 258 may be placed beneath the carriage 244 to help evaporate treating fluid off of the workpieces 14 after the workpieces 14 have been treated in the sump 225 and/or have been showered using the pump and spray mechanism. Additional heating coils (not shown) may be located in the sump 225 to heat the treating fluid 23 located in the sump 225. The chamber 224 also includes a sloped floor 260 that directs liquid treating fluid back into the sump 225. The chamber 224 may also include a lowered ceiling 262, such as between the apertures 228, 230 to reduce the available vapor space within the chamber 224 and thereby reduce the quantity of treating fluid needed to operate the apparatus 210.

When preparing an article, such as the workpiece 14, for treating in the apparatus 210, the carriage 212*a* is first positioned at the station 226 using the drive mechanism, as best depicted in FIG. 15. Then, the workpiece 14 is transferred from the loading position 220 through the opening 46 and into the chamber 213*a*. The workpiece 14 may be provided at the holding location 20 either manually or via a conveyer (not shown). Suitable controls may be provided to link and automate the operation of the conveyer, the drive mechanism, and the hoist mechanism.

After the workpiece 14 is loaded into the chamber 213*a*, the drive mechanism may be activated to move the carriage 212*a* to the station 228 associated with the chamber 224, as depicted in FIG. 16. With the carriage 212*a* positioned at the station 228, the o-rings 68, 70 of the sealing structure 66 are engaged between the plates 234*a*, 238*a* to isolate the chambers 224, 213*a* from the atmosphere.

The source of vacuum may be connected to the conduit 84 (not shown in FIG. 16) to pull a vacuum on the cavity 82 (not shown in FIG. 16), draw the rings 68, 70 (not shown in FIG. 16) into tighter contact with the plates 234*a*, 238*a*, and draw the plate 234*a* into contact with the plate 238*a* proximate the rings 68, 70. The vacuum on the cavity 82 enhances the sealing action of the sealing structure 66 and thereby helps prevent air from entering the chambers 224, 213*a* and helps prevent treating fluid vapor from leaking out of the chambers 224, 213*a*. It is to be understood that the sealing structure 66 provides a substantial amount of sealing action that maintains the hermetic environment in the chambers 224, 213*a*, even absent placing the cavity 82 under vacuum.

As an alternative, prior to placing the openings 46, 58 of the mechanism 216*a* in communication and while the sealing structure 66 is fully engaged against the plate 238*a*, a source of nitrogen may be attached to the carriage 212*a* to sweep air from the chamber 213*a*. This nitrogen sweep of the chamber 213*a* helps prevent introduction of air, including humid air, into the chamber 224. As another alternative, the source of nitrogen may be attached 20 to the conduit 84 to flush any fluid substance, such as air, contained in the cavity 82 to atmosphere via the exhaust pipe 85 (not shown in FIG. 16), and help prevent air from entering the chambers 224, 213*a*.

When removing the workpiece 14 from the apparatus 210, the carriage 212*b* is first positioned at the station 230 using the drive mechanism, as best depicted in FIG. 16. With the carriage 212*b* positioned at the station 230, the o-rings 68, 70 of the sealing structure 66 are engaged between the plates 234*b*, 238*b* to isolate the chambers 224, 213*b* from the atmosphere.

The source of vacuum may be connected to the conduit 84 (not shown in FIG. 16) to pull a vacuum on the cavity 82 (not shown in FIG. 16), draw the rings 68, 70 (not shown in FIG. 16) into tighter contact with the plates 234*b*, 238*b*, and draw the plate 234*b* into contact with the plate 238*b* proximate the rings 68, 70. The vacuum on the cavity 82 enhances the sealing action of the sealing structure 66 and thereby helps prevent air from entering the chambers 224, 213*b* and helps prevent treating fluid vapor from leaking out of the chambers 224, 213*b*. It is to be understood that the sealing structure 66 provides a substantial amount of sealing action that maintains the hermetic environment in the chambers 224, 213*b*, even absent placing the cavity 82 under vacuum.

As an alternative, prior to placing the openings 46, 58 of the mechanism 216*b* in communication and while the sealing structure 66 is fully engaged against the plate 238*b*, a source of nitrogen may be attached to the carriage 212*b* to sweep air from the chamber 213*b*. This nitrogen sweep of the chamber 213*b* helps prevent introduction of air, including humid air, into the chamber 224. As another alternative, the source of nitrogen may be attached to the conduit 84 to flush any fluid substance, such as air, contained in the cavity 82 to atmosphere via the exhaust pipe 85 (not shown in FIG. 16), and help prevent air from entering the chambers 224, 213*b*.

Figure 17:
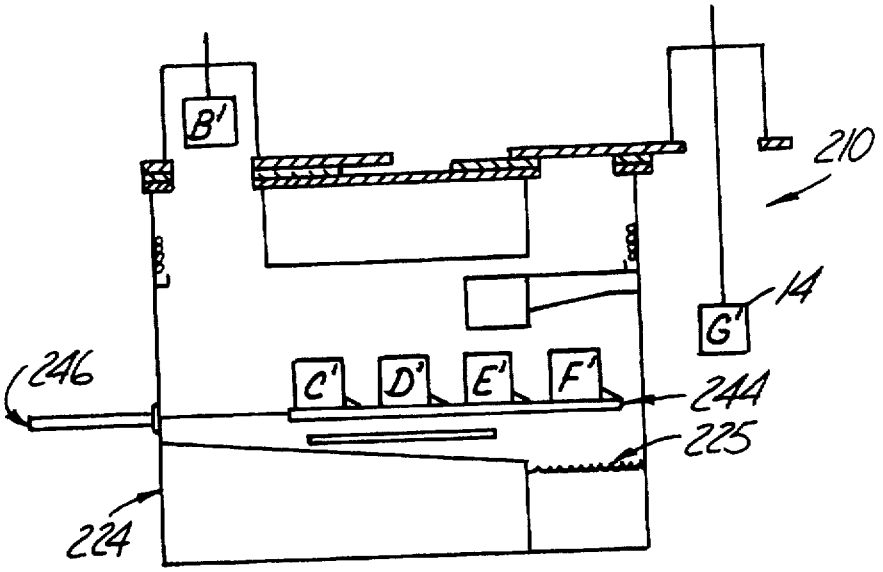
FIG. 17 is another sectional side plan view of another embodiment of the treatment apparatus of the present invention.

After the carriage 212*b* is located at the station 230, the workpiece 14 is transferred from the carriage 244 through the aperture 242 and into the chamber 213*b*, as best depicted in FIG. 17. After the workpiece 14 is loaded into the chamber 213*b*, the drive mechanism may be activated to move the carriage 212*b* to the station 232, as depicted in FIG. 17. The workpiece 14 is then transferred from the chamber 213*b* to the unloading position 222 through the opening 46. The workpiece 14 may be removed from the unloading position 222 either manually or via a conveyer (not shown). Suitable controls may be provided to link and automate the operation of the conveyer, the drive mechanism, and the hoist mechanism.

Whenever the openings 46, 54, 58 of the mechanism 216*a* are aligned and the openings 46, 54, 58 of the mechanism 216*b* are aligned, the sealing structures 66, 86 of mechanisms 216*a*, 216*b* help isolate the chambers 213*a*, 213*b*, and 224 from atmosphere. Whenever the openings 46, 54, 58 of the mechanism 216*a* overlap, but are not aligned, the sealing structures 66, 86 of mechanism 216*a* continue to help isolate the chambers 213*a* and 224 from atmosphere, so long as a width I of the plate 238*a* is at least as large as the diameter of the ring 74 such that portions of the ring 74 that are not exposed to the openings 52, 56 remain in sealing contact with the plate 238*a*, rather than being exposed to atmosphere. Similarly, whenever the openings 46, 54, 58 of the mechanism 216b overlap, but are not aligned, the sealing structures 66, 86 of mechanism 216b continue to help isolate the chambers 213b and 224 from atmosphere, so long as the width I of the plate 238b is at least as large as the diameter of the ring 74 such that portions of the ring 74 that are not exposed to the openings 52, 56 remain in sealing contact with the plate 238b, rather than being exposed to atmosphere.

Furthermore, the sealing action of the sealing structure 86 helps isolate the chamber 224 from atmosphere during movement of the carriage 212a when all portions of the circular openings 54, 58 of the mechanism 216a overlap the plate 234a and the entire length of the o-ring 88 is in sealing contact with the plate 234a. Similarly, the sealing action of the sealing structure 86 helps isolate the chamber 224 from atmosphere during movement of the carriage 212b when all portions of the circular openings 54, 58 of the mechanism 216b overlap the plate 234b and the entire length of the o-ring 88 is in sealing contact with the plate 234b.

The role of the carriage 244 in the procession of workpieces through the chamber 224 may be examined by sequential reference to FIGS. 15–18. In FIGS. 15–18, the workpieces 14 have been designated with letters A'–G' for purposes of tracking movement of different workpieces 14. In FIG. 15, workpiece A' is being lowered to the unloading location 222 from the carriage 212b, and workpiece F' is ready to be loaded into carriage 212a from the loading location 220. Workpieces B'–E' are located on the carriage 244. Referring to FIG. 16, the carriage 244 has been shifted in the direction of arrow G to attach workpiece B', which is still located on the carriage 244, to the hoist mechanism of carriage 212b. Workpieces C'–E' also remain on the carriage 244, while workpiece F' has been lowered from the carriage 212a into the sump 225.

Figure 18:
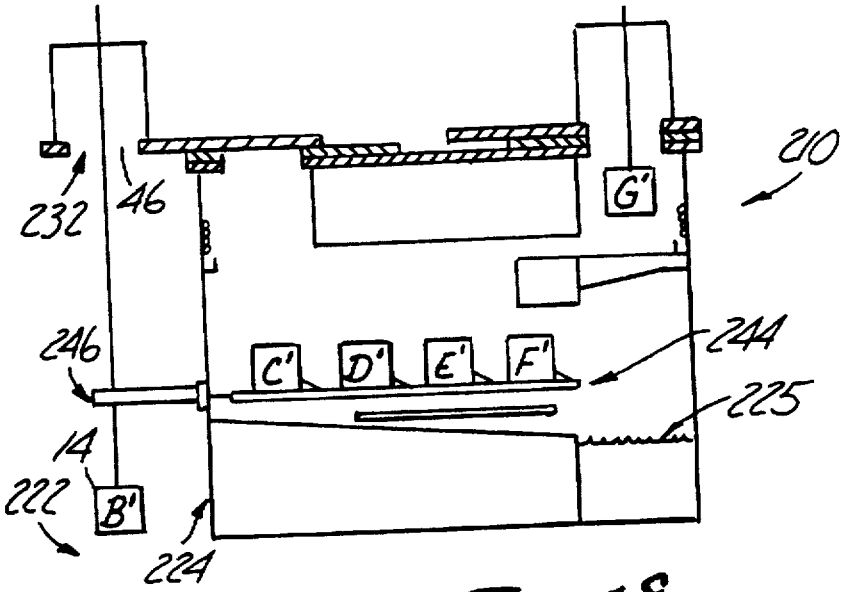
FIG. 18 is another sectional side plan view of another embodiment of the treatment apparatus of the present invention.

Referring to FIG. 17, workpiece B' has been lifted into the carriage 212b from the carriage 244, and new workpiece G' is being raised toward carriage 212a from the loading location 220. Additionally, the carriage 244 has been shifted in the direction of arrow H and the conveyor of the carriage has shifted workpieces C'–E' in the direction of arrow G, relative to the carriage 244. Furthermore, workpiece F' has been transferred from the sump 225 and onto the carriage 244 by the hoist mechanism associated with the carriage 212a. Referring to FIG. 18, workpiece B' has been lowered to the unloading position 222 from the carriage 212b, and the carriage 244 has been shifted in the direction of arrow G to permit workpiece G' to be lowered into the sump 225 from the carriage 212a. Alternatively, the workpiece C' may be loaded into the carriage 212b to permit shifting of workpieces D'–F' in the direction of arrow G, relative to the carriage 244, to enable direct placement of the workpiece G' on the conveyor 244 following movement of the carriage 244 in the direction of arrow H.

Besides demonstrating workpiece 14 movement, FIGS. 15–18 also demonstrate some of the possible movements of the carriages 212a, 212b. For example, the carriages 212a, 212b may be operated simultaneously and independent of each other to yield operational flexibilities. Alternatively, suitable controls may be incorporated in the apparatus 210 to synchronize and coordinate operation of the carriages 212a, 212a.

The apparatus 10, 210 of the present invention provides an innovative and automated solution to the longstanding problem of how to safely and economically treat articles with solvent. The simple structures of the apparatus 10, 210 provide a secure, hermetic environment for treating articles with solvent. The simple structures of the apparatus 10, 210 minimize the cost of purchasing the apparatus 10, 210 and minimize the expense of operating and maintaining the apparatus 10, 210. Also, the apparatus 10, 210 substantially minimize the amount of solvent that is consumed during the treatment operation. The apparatus 10, 210 permit the amount of toxic or expensive solvent and air that mixes in the apparatus 10, 210 to be minimized or eliminated and thereby, minimizes or eliminates toxic or expensive solvent losses from the apparatus 10. The apparatus 10, 210 also prevent the formation of a flammable or explosive mixture of solvent vapor and air and eliminate flammable solvent losses from the apparatus 10, 210 such as during venting, flaring, or vapor recovery operations. Additionally, the apparatus 10, 210 prevent contamination of the treating solvent with water from humid air and thereby further reduce the frequency and complexity of solvent recycling operations.

Although the present invention has been described with reference to preferred embodiments, workers skilled in the art will recognize that changes may be made in form and detail without departing from the spirit and scope of the invention.

What is claimed is:

1. An apparatus for treating a workpiece, the apparatus comprising:

a carriage for holding the workpiece;

a first station for transferring the workpiece into and out of the carriage;

a first chamber for holding treating fluid;

a second station for transferring the workpiece between the carriage and the first chamber;

a seal located proximate the second station;

a positioning plate for supporting the carriage, the positioning plate capable of being placed in sealing contact with the seal for isolating the first chamber from atmosphere;

a mechanism for staging the carriage, the mechanism capable of positioning the carriage at the first station and at the second station; and wherein the first chamber is capable of being isolated from atmosphere when the carriage is located at the second station.

2. The apparatus of claim 1 wherein the first chamber is capable of being isolated from atmosphere when the carriage is located away from the second station.

3. The apparatus of claim 1 wherein the carriage comprises a second chamber for holding the workpiece, the second chamber capable of being isolated from atmosphere when the carriage is located at the second station and when the carriage is located away from the second station.

4. The apparatus of claim 1 wherein the apparatus further comprises:

a backing plate, the backing plate and the positioning plate capable of being placed in sealing contact with the seal for isolating the first chamber from atmosphere.

5. The apparatus of claim 4 wherein the positioning plate and the backing plate are capable of being placed in sealing contact with the seal when the carriage is located away from the second station.

6. The apparatus of claim 4 wherein the positioning plate is capable of being placed in sealing contact with the seal when the carriage is located at the second station and when the carriage is located away from the second station.

7. The apparatus of claim 4 wherein the positioning plate is capable of being placed in sealing contact with the seal for isolating the second chamber from atmosphere when the carriage is located at the second station and when the carriage is located away from the second station.

8. The apparatus of claim 4 wherein the seal comprises a pair of sealing elements.

9. The apparatus of claim 4 wherein the seal, the positioning plate, and the backing plate define a cavity, the apparatus further comprising a source of inert gas for sweeping substances located in the cavity to atmosphere.

10. The apparatus of claim 4 wherein the seal, the positioning plate, and the backing plate define a cavity, the apparatus further comprising a source for pulling a vacuum in the cavity.

11. The apparatus of claim 1, the apparatus further comprising a third station for processing the workpiece, the third station located between the first station and the second station.

12. The apparatus of claim 1, the apparatus further comprising:

a source of pre-treatment fluid in working relationship with the carriage; and a mechanism for contacting the pre-treatment fluid and the workpiece.

13. An apparatus for treating a workpiece, the apparatus comprising:

a carriage for holding the workpiece;

a first station for transferring the workpiece into and out of the carriage;

a first chamber for holding treating fluid;

a second station for transferring the workpiece between the carriage and the first chamber;

a seal located proximate the second station;

a positioning plate for supporting the carriage;

a backing plate, the backing plate and the positioning plate capable of being placed in sealing contact with the seal for isolating the first chamber from atmosphere;

a mechanism for staging the carriage, the mechanism capable of positioning the carriage at the first station and at the second station; and wherein the first chamber is capable of being isolated from atmosphere when the carriage is located at the second station.

14. The apparatus of claimed 13 wherein the first chamber is capable of being isolated from atmosphere when the carriage is located away from the second station.

15. The apparatus of claim 13 wherein the carriage comprises a second chamber for holding the workpiece, the second chamber capable of being isolated from atmosphere when the carriage is located at the second station and when the carriage is located away from the second station.

16. The apparatus of claim 13 wherein the positioning plate and the backing plate are capable of being placed in sealing contact with the seal when the carriage is located away from the second station.

17. The apparatus of claim 13 wherein the positioning plate is capable of being placed in sealing contact with the seal when the carriage is located at the second station and when the carriage is located away from the second station.

18. The apparatus of claim 13 wherein the positioning plate is capable of being placed in sealing contact with the seal for isolating the second chamber from atmosphere when the carriage is located at the second station and when the carriage is located away from the second station.

19. The apparatus of claim 13 wherein the seal comprises a pair of sealing elements.

20. The apparatus of claim 13 wherein the seal, the positioning plate, and the backing plate define a cavity, the apparatus further comprising a source of inert gas for sweeping substances located in the cavity to atmosphere.

21. The apparatus of claim 11 wherein the seal, the positioning plate, and the backing plate define a cavity, the apparatus further comprising a source for pulling a vacuum in the cavity.

22. The apparatus of claim 11 the apparatus further comprising a third station for processing the workpiece, the third station located between the first station and the second station.

23. The apparatus of claim 11, the apparatus further comprising:

a source of pre-treatment fluid in working relationship with the carriage; and a mechanism for contacting the pre-treatment fluid and the workpiece.

* * * * *

UNITED STATES PATENT AND TRADEMARK OFFICE

CERTIFICATE OF CORRECTION

PATENT NO. : 5,799,677

DATED : SEPTEMBER 1, 1998

INVENTOR(S) : WINSTON E. SABATKA ET AL.

It is certified that error appears in the above-identified patent and that said Letters Patent is hereby corrected as shown below:

Col. 18, line 1, delete "claimed", insert --claim--

Signed and Sealed this

Seventh Day of December, 1999

*Attest:*

Q. TODD DICKINSON

*Attesting Officer*

*Acting Commissioner of Patents and Trademarks*